US006296492B1

(12) United States Patent
Fujimoto et al.

(10) Patent No.: US 6,296,492 B1
(45) Date of Patent: Oct. 2, 2001

(54) RECEPTACLE FOR COAXIAL PLUG CONNECTOR

(75) Inventors: Masaki Fujimoto; Shuji Kato, both of Tsu; Kenji Okura, Hisai; Yoshihisa Inaba, Matsusaka; Takeshi Hashimoto, Nishinomiya; Narutoshi Hoshino, Katano; Hiroyuki Tominaga, Soka; Shinya Sasaki, Minamisaitama-gun, all of (JP)

(73) Assignee: Matsushita Electric Works, Ltd., Kadoma (JP)

( * ) Notice: Subject to any disclaimer, the term of this patent is extended or adjusted under 35 U.S.C. 154(b) by 0 days.

(21) Appl. No.: 09/820,750

(22) Filed: Mar. 30, 2001

(30) Foreign Application Priority Data

Mar. 31, 1920 (JP) ..... 12-099337
Mar. 31, 1920 (JP) ..... 12-099338
May 26, 1920 (JP) ..... 12-157273

(51) Int. Cl.[7] ..... H01R 12/00

(52) U.S. Cl. ..... 439/63; 439/188

(58) Field of Search ..... 439/188, 63, 247, 439/248, 289, 700, 824, 578, 607, 609; 200/51 R

(56) References Cited

U.S. PATENT DOCUMENTS 5,104,325 * 4/1992 Mitani et al. ..... 439/63
6,224,407 * 5/2001 Duquerroy et al. ..... 439/188
6,239,385 * 5/2001 Schwiebert et al. ..... 439/63

FOREIGN PATENT DOCUMENTS

WO 98/31078 7/1998 (WO) .

* cited by examiner

*Primary Examiner*—Khiem Nguyen
(74) *Attorney, Agent, or Firm*—Oblon, Spivak, McClelland, Maier & Neustadt, P.C.

(57) ABSTRACT

A compact receptacle for mating connection with a complementary coaxial plug connector. The receptacle is in use to be mounted on a mobile phone for switching a signal line from an internal antenna to a vehicle's external antenna when placed on a cradle in a vehicle in mating connection with the plug connector on the cradle. The receptacle has a dielectric mold carrying an outer conductor shield fitted on top of the mold, a single spring member, and a single fixed contact member. The conductor shield includes an electrode socket for connection with an outer conductor tube of the plug. The spring member integrally carries a center electrode for connection with a center conductor post of the plug, and a movable contact which forms a normally-closed switch with a fixed contact on the fixed contact member for the above signal switching.

15 Claims, 7 Drawing Sheets

RECEPTACLE FOR COAXIAL PLUG CONNECTOR

BACKGROUND OF THE INVENTION

1. Field of the Invention

The present invention is directed to a receptacle for a coaxial plug connector, and more particularly to such a receptacle of compact design.

2. Description of the Prior Art

As disclosed in WO 98/31078, a receptacle has been proposed in combination with a self-aligning coaxial plug connector to facilitate a one-touch connection, while compensating for misalignment of the plug and the receptacle. Particularly in the field of connecting a mobile phone to a cradle in a vehicle for switching a signal line from a phone's internal antenna to an external antenna installed on the vehicle, the receptacle on the side of the mobile phone is required to have a set of contacts for switching the signal line, in addition to a center electrode and an outer electrode respectively for connection with a center conductor post and an outer conductor tube of the plug connector. The above publication teaches the use of a pin as the center electrode projecting into a socket for receiving the plug end and two other separate parts, one being a spring member carrying a movable contact, and the other defining a fixed contact which is engageable with the movable contact to provide a normally-closed switch for switching the signal line. The pin is mounted to a dielectric mold to have its one end projecting into the socket and to have the other end engaged with the spring member so that, upon the pin comes into contact with the center conductor post, the pin pushes and deform the spring member resiliently for opening the contacts, thus establishing the signal line leading to an transceiver circuit of the mobile phone from the external antenna through the plug connector, the pin, and the spring member. As the pin and the spring member are arranged in tandem along the axis of the receptacle for enabling the above switching, the length of the pin adds an extra height dimension to the receptacle, which is a hindrance to making the receptacle compact. Further, the pin itself adds the number of discrete parts for assembly the receptacle, resulting in a manufacture cost increase.

SUMMARY OF THE INVENTION

The above insufficiency has been reduced in the present invention which provides an improved receptacle adapted for mating connection with a coaxial plug connector and capable of being made compact with a reduced manufacturing cost. The receptacle in accordance with the present invention comprises a dielectric mold having a cavity, an outer conductor shield fitted on top of the mold, a single spring member, and a single fixed contact member. The conductor shield is formed with an electrode socket for connection with an outer conductor tube of the coaxial plug connector. The electrode socket has at its axial end a bottom with a center opening which communicates with the cavity of the mold. The outer conductor shield includes a ground terminal lug projecting outwardly of the mold for electrical connection with an external circuit. The spring member is mounted to the mold and has a center electrode resiliently movable along the axis of the socket. The center electrode extends from the cavity into the center opening of the socket for pressed contact with a center conductor post of the coaxial plug connector. The spring member carries a movable contact which is disposed within the cavity and is movable together with the center electrode, and includes a first signal terminal lug projecting outwardly of the mold for electrical connection with the external circuit. The fixed contact member is also mounted to the mold and has a fixed contact which is normally engaged with the movable contact due to the bias of the spring member and is disengaged from the movable contact when the center electrode is depressed by the center conductor post of the coaxial plug connector. The fixed contact member includes a second terminal lug projecting outwardly of the mold for electrical connection with the external circuit. Thus, the receptacle can be assembled from only four discrete parts, while giving the signal line switching operation in response to receiving the coaxial plug connector. Further, since the center electrode extends integrally from the spring member into the socket for direct contact with the center conductor post of the coaxial plug connector, the receptacle can be dispensed with any additional separate contact member which would adds an extra length or height to the receptacle. Accordingly, the receptacle can be made compact particularly with respect to the height dimension and be assembled with the reduced manufacturing cost.

In the preferred embodiment, the outer conductor shield is supported onto the peripheral wall of the mold to project the bottom of the socket into the cavity. Thus, the mold can absorb a fraction of the socket length required for receiving the plug connector, thereby minimizing the height of the receptacle.

The spring member is preferably formed by a single metal sheet to have the center electrode integrally struck therefrom and the movable contact bulged therefrom, simplifying the structure of the combination of the center electrode and the movable contact for reduced manufacturing cost.

Further, the spring member may be formed with a first stab at an intermediate portion between the first terminal lug and the center electrode. The first stab is inserted into the mold for mounting the spring member to the mold. The movable contact is located at a portion adjacent the center electrode and opposite of the first stab from the center electrode so as to have sufficient stroke for opening the contacts.

The center electrode may be designed to have a resiliently deformable contact tip for pressed contact with the center conductor post of the coaxial plug connector.

Preferably, the movable contact is disposed within the cavity behind the bottom of the socket to be spaced from the center opening in a lateral direction perpendicular to the axis of the socket. Thus, the movable contact is concealed behind the bottom of the socket and to be protected from being jammed up by a foreign matter.

In order to give a sufficient stroke to the center electrode as well as the movable spring with a limited length of the spring member, the spring member is specially configured to have a bent portion extending between the first stab and the center electrode.

In the preferred embodiment, the center electrode is of an L-shaped configuration to have a vertical leg extending along the axis of the socket and a contact tip extending horizontally from one end of the leg in a direction perpendicular to the axis of the socket for direct contact with the center conductor post of the coaxial plug connector. Further, the contact tip may have a return bent tab extending back into the center opening to reduce a gap between the contact tip and the periphery of the opening so as to prevent the clogging of a foreign matter which would impede the movement of the center electrode.

In the meanwhile, thus configured receptacle can be suitably combined with the coaxial plug connector having a compact structure. The plug connector includes a mount base adapted to be fixed to a mounting structure; and a coaxial plug having a longitudinal axis and supported to the mount base to project therefrom. The coaxial plug has an insertion end at one axial end thereof for mating connection with the receptacle and has an anchor end at the opposite axial end for connection with the coaxial cable. The outer conductor tube of the plug surrounds the center conductor post in an electrically insulating relation therefrom by means of a dielectric member fitted within the outer conductor tube. The dielectric member occupies a fraction of a space between the center conductor post and the outer conductor tube, thereby leaving an air layer extending along the length of the coaxial plug within the space. By provision of the air layer along the coaxial plug, the outer conductor tube can be spaced from the center conductor post by a reduced radial distance due to the large dielectric constant of the air layer, thereby making the plug and the complementary receptacle compact with respect to the radial dimension thereof.

The air layer can be realized by use of a specially configured dielectric member. For instance, the dielectric member is shaped into a barrel which surrounds the center conductor post and has rings spaced axially along the plug. The rings are held in close contact with the outer conductor tube to retain the barrel within the tube. The barrel has its outer surface spaced radially from the tube to leave the air layer extending along the plug between the axially spaced rings. Further, an additional air layer may be formed between the barrel and the center conductor post for minimizing the radial dimension of the plug.

These and still other objects and advantageous features of the present invention will become apparent from the following description of the embodiment, when taken in conjunction with the attached drawings.

DETAILED DESCRIPTION OF THE EMBODIMENTS

Figure 7:
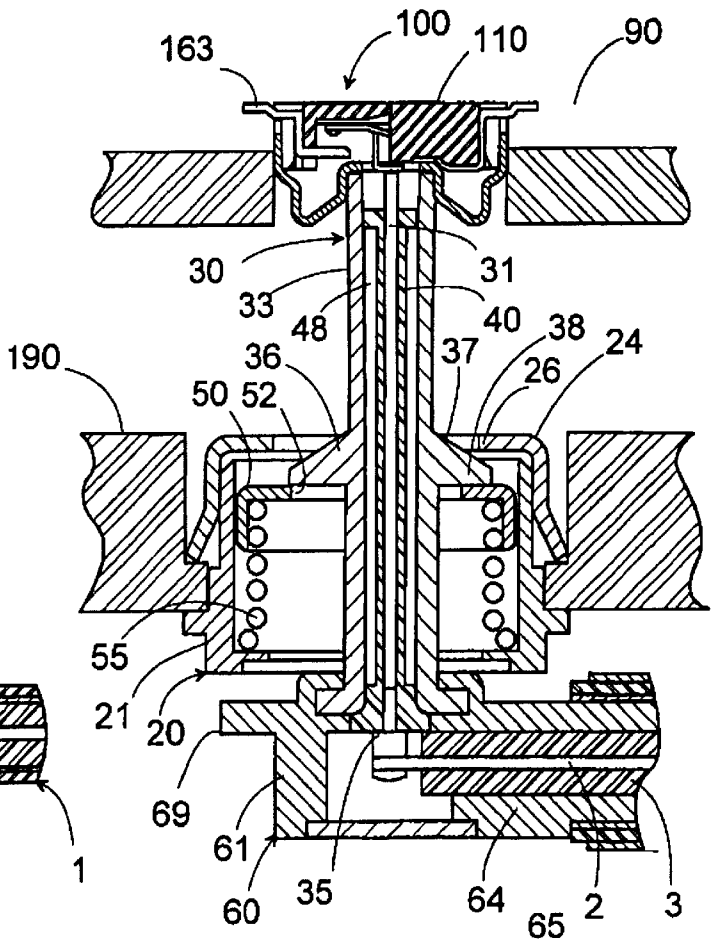
FIGS. 6 and 7 are vertical sections of the receptacle shown with a complementary coaxial plug connector, respectively.
Figure 6:
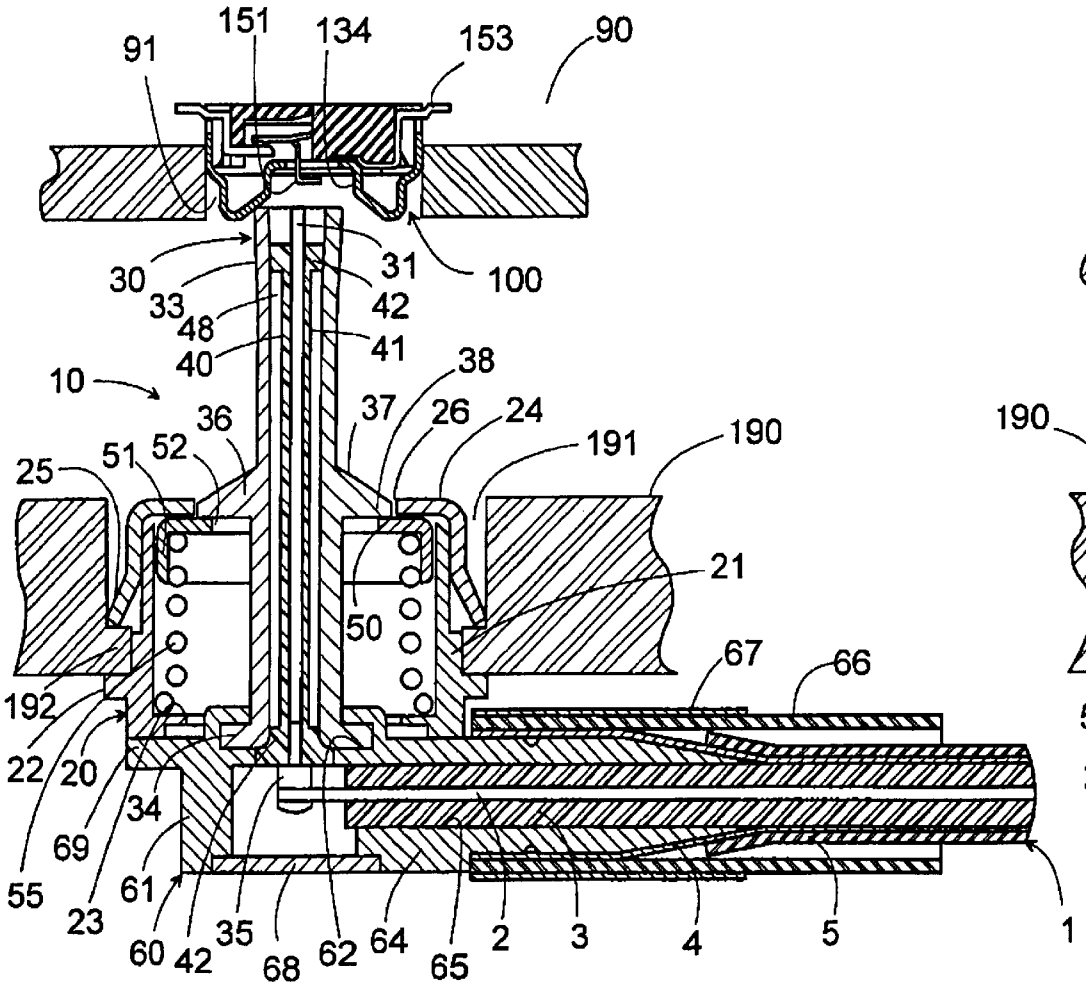

Referring now to FIGS. 1 to 5, there is shown a receptacle 100 adapted to receive a complementary coaxial plug connector 10 in accordance with a preferred embodiment of the present invention. The coaxial plug connector 10 is designed for connecting a coaxial cable 1 to the receptacle 100, and is specifically adapted for detachable connection of a mobile phone to a cradle carried on a vehicle for hands-free operation in driving. More particularly, the combination of the coaxial plug connector 10 and the receptacle is used to switch a signal line from a phone's internal antenna to a vehicles external antenna for increasing the antenna gain when the phone is operated in the vehicle. The receptacle 100 is mounted on a mobile phone casing 90, while the plug connector 100 is mounted on a cradle housing 190. The receptacle 100 is shaped into a low-profile configuration and is received within a hole 91 of the thin-wall mobile phone casing 90, as shown in FIGS. 6 and 7. The coaxial plug connector 100 comprises a mount base 20 supporting a coaxial plug 30 composed of a center conductor post 31 surrounded by a dielectric 40, and an outer conductor tube 33. The plug 30 defines an insertion end at its one axial end for mating engagement into an electrode socket 134 in the receptacle 100, and defines an anchor end at the opposite axial end for connection with the coaxial cable 1.

Figure 1:
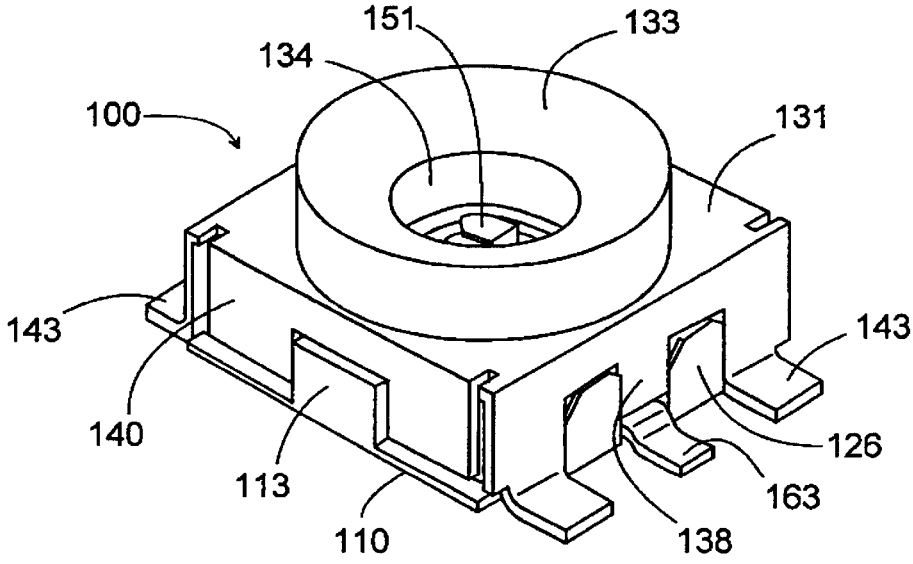
FIG. 1 is a perspective view of a receptacle in accordance with a preferred embodiment of the present invention.
Figure 2:
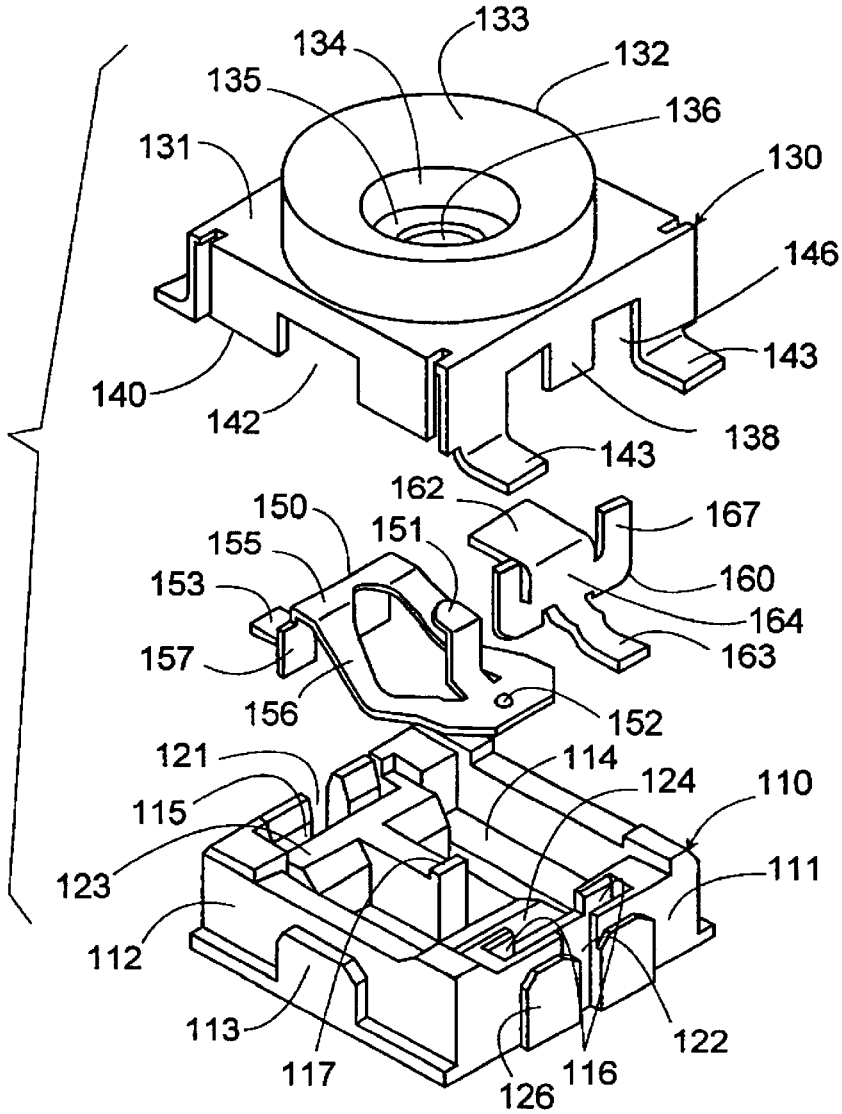
FIG. 2 is an exploded perspective view of the receptacle.
Figure 3:
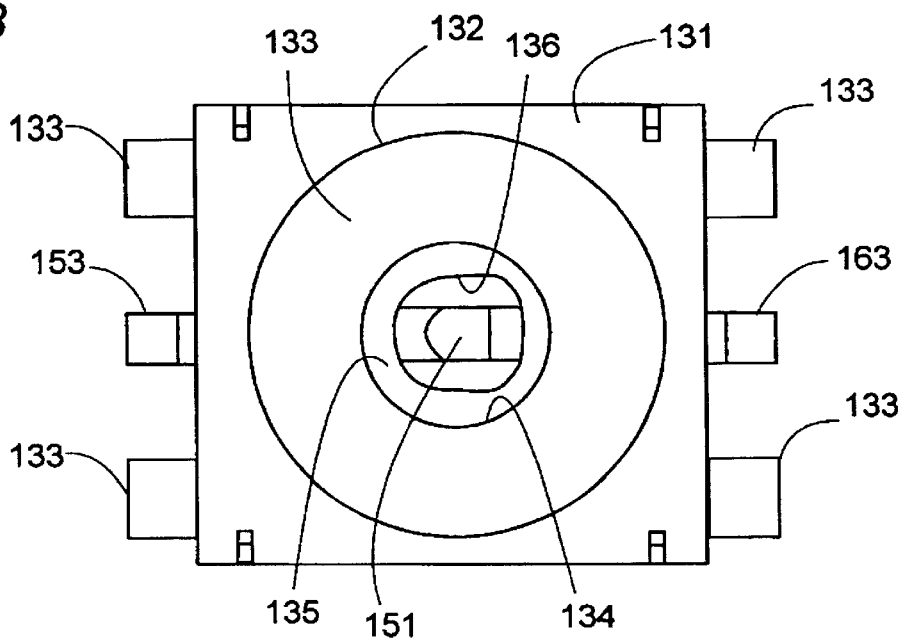
FIGS. 3 to 5 are respectively a top view, a vertical section, and a side view of the receptacle.
Figure 4:
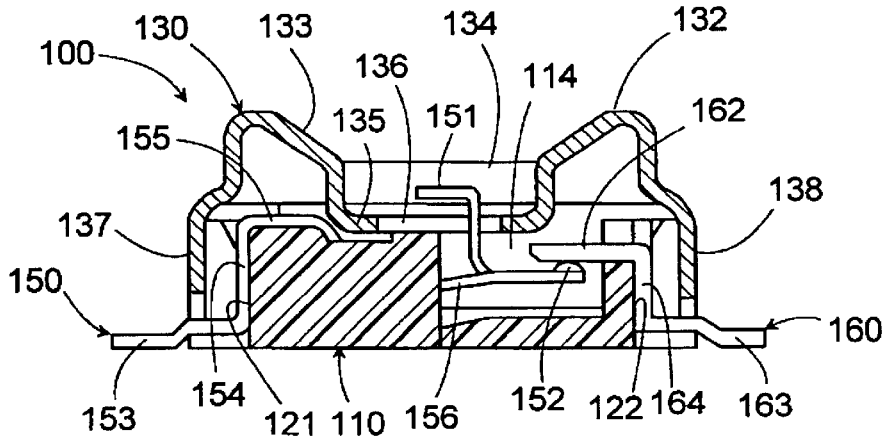
Figure 5:
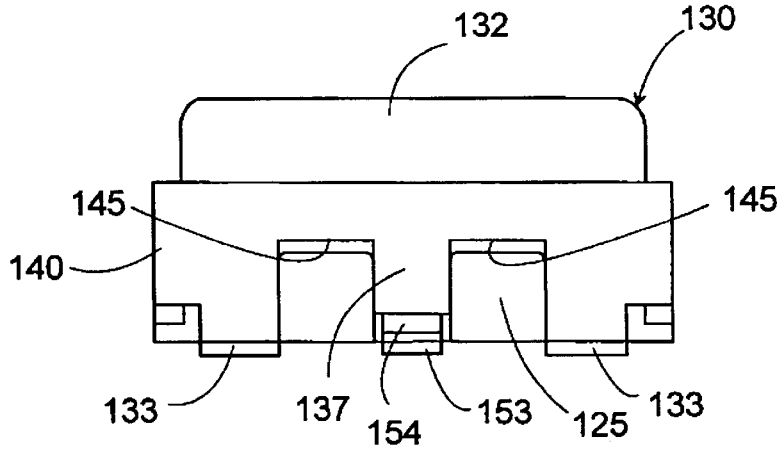

As best shown in FIG. 2, the receptacle 100 consists of four separate parts, namely, a flat dielectric mold 110, an outer conductor shield 130, a spring member 150, and a fixed contact member 160. The mold 110 is shaped into a rectangular configuration having a closed bottom and a periphery surrounding a top open cavity 114 within which major portions of the spring member 150 and the fixed contact member 160 are received. The periphery of the mold 110 is defined by opposed end walls 111 and opposed side walls 112 joining the end walls. The conductor shield 130 is made of a copper to have a rectangular frame 131 and an integral annulus 132 projecting centrally from the top of the frame 131 and defining therein the electrode socket 134 which is a round recess having an upright axis for receiving the insertion end of the coaxial plug 30. The annulus 132 has a top inclined guide face 133 which guides the insertion end of the plug 30 into the socket 134 to accommodate the misalignment between the plug connector 10 and receptacle 100, as will be discussed hereinafter. Formed at the bottom of the socket 134 is an inward flange 135 for abutment against the end of the outer conductor tube 33 of the plug 30. The inward flange 135 surrounds a round opening 136 through which the movable contact member 140 is exposed for connection with the center conductor post 31 of the plug 30. The frame 131 is also integrally formed with a skirt 140 which overlaps the periphery of the mold 110 and is secured thereto by pressed engagement of projections 113 on opposite side walls 112 into corresponding notches 142 of the skirt 140. Also integrally formed with the frame 131 are ground terminal lugs 143 which project horizontally outwardly from the bottom of the conductor shield 130 or the mold 110 for surface mounting of the receptacle 100 on a printed board in the mobile phone casing 90. It is noted in this connection that, as shown in FIG. 4, the bottom of the socket 134 extends into the cavity 114 of the mold 110 when the conductor shield 130 is mounted on top of the mold, i.e., the periphery of the frame 131 is supported on top of the periphery of the mold 110.

Figure 8:
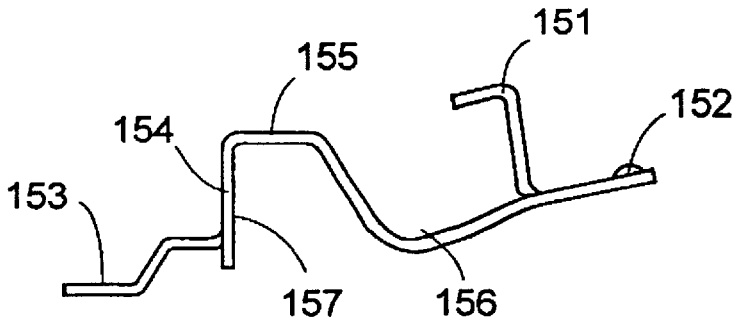
FIG. 8 is a front view of a spring member utilized in the receptacle.

The spring member 150 is formed from a metal plate to have a resiliently deformable center electrode 151 and a movable contact 152 at one end, a first terminal lug 153 at the other end, and a bridge integrally joining the center electrode 151 and the terminal lug 153. The terminal lug 153 is adapted for connection with the RF signal line of a transceiver circuit of the mobile phone which receives the RF signal selectively from the internal antenna of the mobile phone and the external antennal of the vehicle. As best shown in FIGS. 2, 4 and 8, the bridge includes a vertical segment 154 upstanding from the terminal lug 153, a horizontal segment 155 extending from the upper end of the vertical segment 154, and a cantilever portion 156 extending from the horizontal segment 155 to the center electrode 151 for imparting the resilient deformability to the center electrode 151. A pair of stabs 157 depend from the horizontal segment 155 and are press-fitted into a corresponding slit 115 of the mold 110 to mount the spring member 150 to the mold 110 such that the cantilever portion 156 is resiliently deformable within the cavity 114, allowing the center electrode 151 and the movable contact 152 to move in the axial direction of the socket 136. The center electrode 151 projects through the opening 136 into the socket 134 for pressed contact with the center conductor post 31 of the plug 30. It is noted in this connection that the center electrode 151 projects into the socket 134 for successful connection to the counterpart center conductor post 31 which is required to be recessed from the top end of the outer conductor tube 33 for keeping the post 31 intact and avoiding the post from damaging a surrounding parts or injuring the human body. The terminal lug 153 extends outwardly from the bottom of the end wall 111 of the mold 110 in a coplanar relation with the ground terminal lug 143.

The fixed contact member 160 is shaped into a Z-shaped configuration having a fixed contact 162 engageable with the movable contact 152 and a second terminal lug 163 extending outwardly from the bottom of the sidewall 112 of the mold 110 for connection with an internal antenna of the mobile phone. The fixed contact 162 is defined by a horizontal segment which is integrally connected to the terminal lug 163 through a vertical segment 164. A pair of stabs 167 extend in a coplanar relation with the vertical segment 164 and are press-fitted into corresponding slits 116 in the mold 110 for mounting the fixed contact member 160 with the fixed contact 162 kept in contact with the movable contact 152, as shown in FIG. 4.

The mold 110 is formed in the external surface of the opposite end walls 111 respectively with a first vertical groove 121 and a second vertical groove 122 each running the full height of the end walls for receiving the vertical segment 154 of the spring member 150 and the vertical segment 164 of the fixed contact member 160, respectively. Thus, the first and second terminal lugs 153 and 163 extend horizontally outwardly from the lower end of the grooves 121 and 122. The end walls 111 have inward convexes 123 and 124 of which height is slightly lower than the end wall for bearing the horizontal segment 155 of the spring member 150 and the horizontal segment 162 of the fixed contact member 160, respectively, as best shown in FIG. 4. The first and second grooves 121 and 122 are open to the cavity 114 only through horizontal channels respectively defined above the inward convexes 123 and 124. Therefore, after the shield 130 is assembled to the mold 100, the grooves 121 and 122 are made to communicate with the cavity 114 only through the clearance between the channels and the corresponding horizontal segments 155 and 162 received therein.

The shield 130 has a first extension 137 and a second extension 138 which depend from the rectangular plane of the frame 131 to points immediately upwardly of the first terminal lug 153 and the second terminal lug 163, while overlapping the major portions of the corresponding vertical segments 154 and 164, respectively in an electrically spaced relation therefrom, as best shown in FIG. 4. Thus, the individual grooves 121 and 122 fitted with the vertical segments 154 and 164 are closed by the extensions to a considerable extent, thereby leaving only a small air-escape passage leading from around the terminal lugs to the center opening 136 of the shield 130 through the cavity 114. This is particularly advantageous for sucking the receptacle 100 by vacuum during an automated assembly of transporting the receptacle from a part line to an assembly line. The terminal lugs 153 and 163 are formed to have steps at portions immediately adjacent the lower ends of the extensions to keep a reduced clearance therebetween, while satisfying requirements of placing the terminal lugs 153 and 163 in alignment with the bottom of the mold 110 for surface mounting of the receptacle and of reducing an area of skirt 140 opposing the spring member 150 and the fixed contact member 160 for an optimum impedance matching.

It is noted in this connection that the extensions 137 and 138 of the shield 130 are defined between notches 145 and 146 in the skirt 140 which engage respectively with corresponding projections 125 and 126 for tightly securing the shield to the mold as well as to keep the extensions 137 and 138 in correct positions. The notches 145 and 146 are desirous also for reason of reducing the area of the skirt 140 to realize the optimum impedance matching between the shield 130 and the individual RF signal lines, i.e., the spring member 150 and the fixed contact member 160. Also for making the impedance matching, the stabs 157 and 167 of the spring member and the fixed contact member may be perforated to reduce a capacitance between these members and the skirt of the shield 130. The mold 110 has a stopper stand 117 extending immediately below the bent contact tip of the center electrode 151 which bears the contact tip depressed by the center conductor post 31 of the coaxial plug 30. It is noted in this connection that the contact tip and the associated vertical leg extending from the cantilever portion 156 are also given a resilient deformability which is additive to resilient deformability of the cantilever portion 156 for reliable pressed contact of the center electrode 151 with the center conductor post 31 of the coaxial plug 30.

Figure 9:
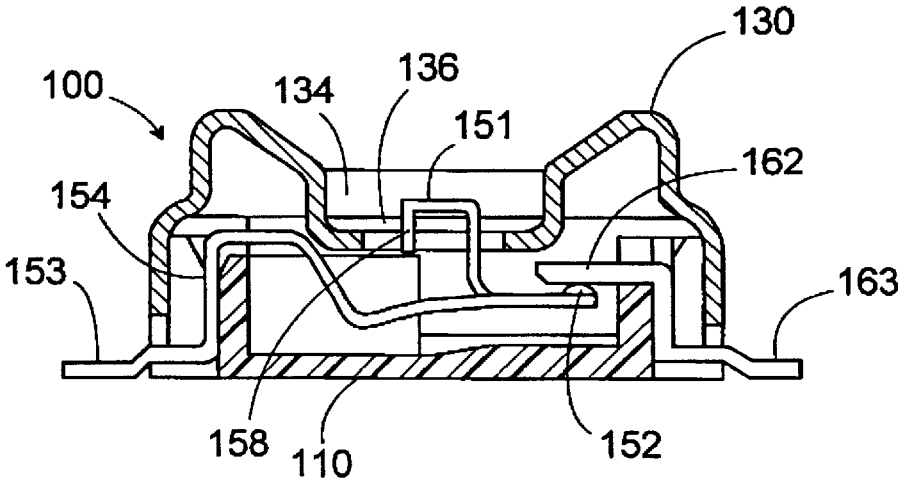
FIG. 9 is a vertical section of a modified receptacle.

As shown in FIG. 8, the spring member 150 is formed to have the cantilever portion 156 bent for exhibiting an increased resiliently deformability within a limited length so that the center electrode 161 and the movable contact 152 are movable by a long stroke along the axis of the socket 134, which contributes to reduce the radial size of the receptacle 100. As shown in FIG. 9, the contact tip of the center electrode 151 may have a return bent tab 158 which extends back into the center opening 136 of the socket 134 for reducing a gap between the contact tip and the periphery of the opening for preventing clogging of a foreign matter which would impair the contact tip.

Although in the above description, the center electrode 151 and the movable contact 152 are both explained to be formed as integral parts of the spring member 150, either one or both of these parts may be prepared separately from the spring member 150 and be subsequently assembled permanently thereto to make the spring member undividable.

Figure 10:
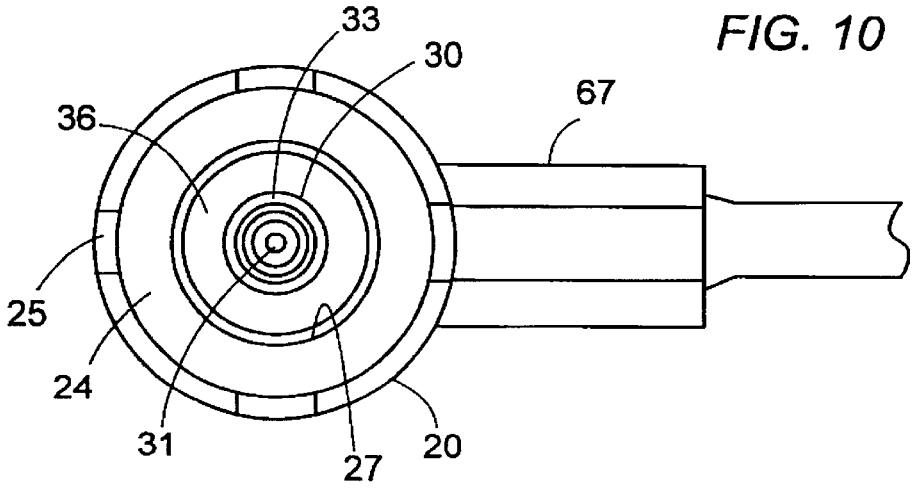
FIGS. 10 to 12 are respectively a top view, a front view, and a bottom view of the coaxial plug connector.
Figure 11:
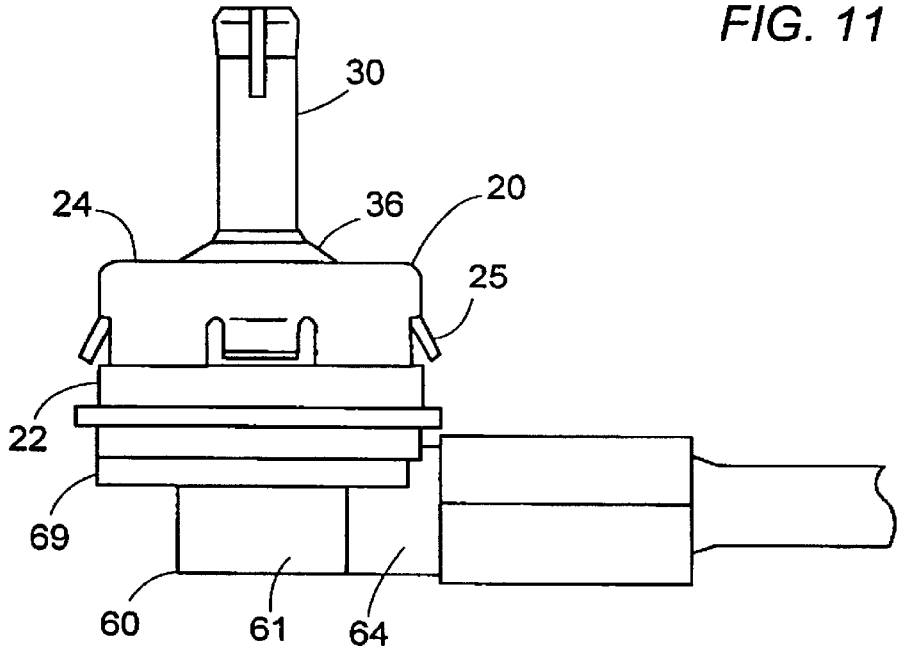
Figure 12:
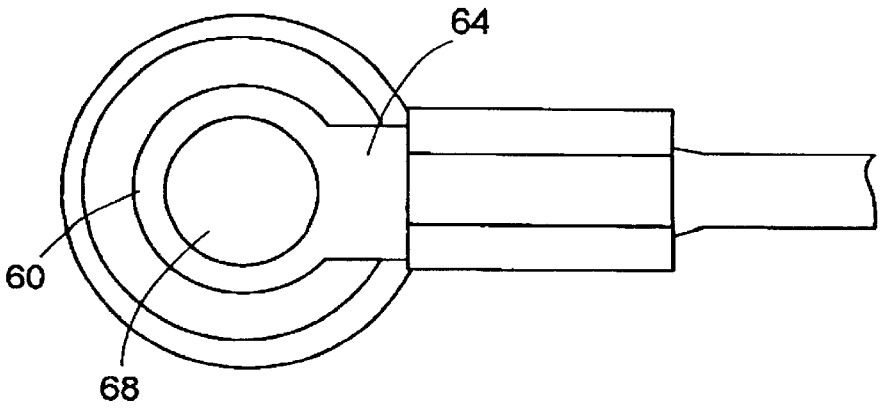

Now referring back to FIGS. 6 and 7, and further to FIGS. 10 to 12, the structure of the coaxial plug connector 10 is explained in detail. Although the illustrated plug connector 10 is a good counterpart of the receptacle 100 as disclosed in this description, the receptacle 100 may be adapted for any other applicable types of coaxial plug connector. The plug connector 10 includes the coaxial plug 30 floatingly supported by the mount base 20. The mount base 20 is disposed in a hole 191 formed in the cradle housing 190, and is composed of a top and bottom open hollow cylinder 21 and a top cover 24 which is secured to the cylinder 21 and has a plurality of bent tabs 25 for engagement with an annular projection 192 at the bottom of the hole. The cylinder 21 has a rim 22 which abuts against a bottom periphery of the hole to fix the mount base 20 to the casing 90 in combination with the tabs 25. The top cover 24 has an opening through which the coaxial plug 30 projects. The anchor end of the coaxial plug 30 extends through the bottom of the cylinder 21 and is coupled to a joint 60 for connection with the coaxial cable 1 having a center conductor 2, a dielectric 3, an outer conductor shield 4, and the dielectric sheath 5.

The joint 60 comprises a sleeve 61 aligned with the coaxial plug 30 and a coupling tube 64 integrally extending in a lateral direction perpendicular to the axis of the plug 30. The sleeve 61 is secured to the anchor end of the coaxial plug 30 by engagement of an outer flange 34 at the anchor end with a corresponding catch 62 at the upper end of the sleeve 61. The coupling tube 64 is dimensioned to have the outer conductor shield 4 of the coaxial cable 1 fitted therearound and to have the dielectric 3 inserted into a bore 65 of the tube 64. For facilitating the connection with the cable 1, the tube 64 has a tapered section 65 which forces the outer conductor shield 4 apart from the dielectric 3. A dielectric ferrule 66 is wrapped around the shield 4 over the tube 64 and is squeezed on the tube by means of a strain bushing 67 for securely connecting the cable 1 to the joint 60. Then, the center conductor 2 of the cable 1 is soldered to a stud 35 at the lower end of the center conductor post 31 by means of a soldering tool inserted into the sleeve through the bottom opening thereof. After the soldering connection, the bottom opening of the sleeve 61 is closed by a lid 68. The joint is also formed around the upper end of the sleeve 61 with a stopper ring 69 which is engageable with the bottom end of the mount base 20 for limiting the axial movement of the coaxial plug 30.

The coaxial plug 30 is floatingly supported to the mount base 20 by means of a slider 50 and a coil spring 65 so as to be axially depressed against the bias of the spring 55. The slider 50 is in the form of a ring with a depending annular fringe 51 and is received within the cylinder 21 of the mount base 20 with the annular fringe 51 kept in sliding contact with the interior wall of the cylinder 21 to be slidable in the axial direction of the plug 30 and is urged by the spring 55 interposed between the slider 50 and an inner flange 23 at the bottom of the cylinder 21. An opening 52 is formed centrally in the slider 50 to pass therethrough the plug 30 in such a manner as to allow the plug 30 to move freely relative the slider 50 in the lateral direction perpendicular to the axis of the plug within a limited extent. Formed at an axial center of the plug 30 is an integral collar 36 which rests on the slider 50 so that the plug 30 is movable axially together with the slider 50 under the urgence and against the bias of the spring 55. The collar 36 is shaped into a conical configuration with an conical face 37 inclined with respect to the axis of the plug 30 and has a root annular section 38 dimensioned to be fit into a round opening 26 of the top cover 24 when the plug is in a non-depressed position as shown in FIG. 6.

Thus, the plug 30 is movable axially together with the slider 50 relative to the mount base 20 as well as movable laterally relative to the slider 50, thereby assuring successful mating engagement of the plug 30 into the electrode socket 134 of the receptacle even in the presence of a misalignment between the plug 30 and the receptacle 100. When placing the mobile phone casing 90 on the cradle housing 190 in the presence of the misalignment, the plug 30 first comes engagement with an inclined guide face 133 leading to the socket 134 and is guided thereby to move laterally while being depressed axially into a correct position for mating connection with the socket 134. In this sense, the slider 50, the collar 36, and the spring 55 constitutes an aligning mechanism which accommodates the misalignment for successfully connecting the plug 30 with the receptacle 100. In the depressed position, the center conductor post 31 and the outer conductor tube 33 are kept pressed against a center electrode 151 and the electrode socket 134, respectively for reliable electrical connection. When the plug 30 is correctly engaged into the socket 134, the center conductor post 31 pushes the center electrode 151 to deform the spring member 150, thereby opening the contacts for switching the signal line from the internal antenna of the mobile phone to the external antenna equipped on the vehicle.

Further, the inclined surface 37 of the collar 36 is cooperative with an inner periphery 27 of the top cover 24 of the mount base 20 around the opening 26 to realize a self-centering mechanism which enables the plug 30 to return to a lateral center position upon being disconnected from the receptacle 100. After the plug 30 is disconnected from the receptacle 100, i.e., released from the depressed position in which the plug 30 is offset laterally for mating connection with the receptacle 100, the plug 30 is urged to move from the depressed position axially into the non-depressed position by the force of the spring 55, during which the inclined surface 37 of the collar 36 comes into sliding contact with the inner periphery 27 around the opening 26 of the cop cover 24 so as to convert the axial movement of the plug into the lateral movement thereof. Whereby the root section 38 of the collar 36 is guided into the opening 26 of the top cover 24 for returning the plug into the lateral center position. Thus, the plug 30 can be centered by itself with an aid of the spring 55. After being centered by engagement of the root section 38 into the opening 26, the stopper ring 69 of the joint 60 abuts against the bottom end of the mount base 20 to retain the plug 30 in this position. Thus, in addition to the self-alignment function, the plug connector further includes the self-centering mechanism which causes the coaxial plug to return to the center position after the coaxial plug is disconnected from the receptacle. Accordingly, each time the coaxial plug is disconnected from the receptacle, it can be centered to the original center position, to be ready for next successful blind connection. In this sense, the illustrated coaxial plug connector is advantageously utilized in combination with the receptacle disclosed herein or with receptacle of other types. The collar 36 may be additionally formed at its lower end immediately behind the root section with a stopper annulus which abuts against the top cover 24 around the opening 26 when the plug is centered.

The cover plate 24 and the collar 36 are each made of a metal to have good resistance to friction wearing at the interface therebetween. The inner periphery 27 of the top cover 24 may be also inclined with respect to the axis of the plug or rounded in conformity to the inclined face of the collar 36 for smoothly centering the plug 30. The collar 36 may be alternatively shaped into a pyramid having plural lateral inclined faces for sliding contact with the inner periphery of the opening 26. Further, the collar 36 may be formed separately formed from the plug 30 and is secured thereto.

Turning back to FIG. 6, the coaxial plug 30 is made compact with regard to the radial dimension while retaining optimum impedance by interposing an air layer 48 between the center conductor post 31 and the outer conductor tube 33. To provide the air layer 48, the dielectric 40 is specially configured into a barrel 41 having a pair of retainer rings 42 at the axial end of the barrel 41. The barrel 41 is inserted within the outer conductor tube 33 and is secured thereto by snugly engaging the rings 42 to the inside wall of the tube 33. The barrel 41 has an outside diameter less than the inside diameter of the tube 33 so as to define the between the rings the air layer 48 extending along the axis of the plug 30. The center conductor post 31 is snugly fitted within the barrel 41.

Figure 13:
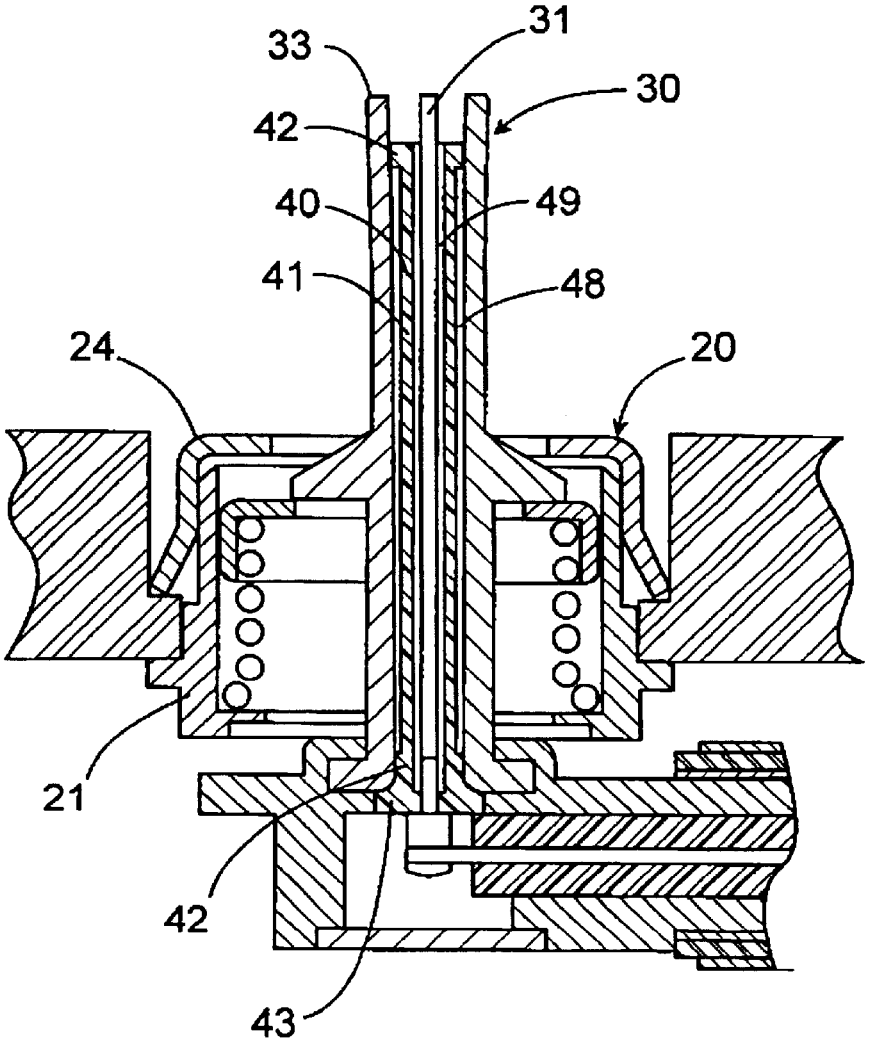
FIG. 13 is a vertical section of a modified coaxial plug connector.

In addition, as shown in FIG. 13, the barrel 41 may be shaped to have a larger inside diameter than the outside diameter of the center conductor post 31 to define therebetween an additional air layer 49 extending the full length of the plug 30 for further reducing the radial dimension of the plug 30. With the use of thus configured plug 30, the receptacle can be made compact accordingly. The lower end of the center conductor post 31 snugly fits into the ring 42 to be supported thereby.

Figure 14:
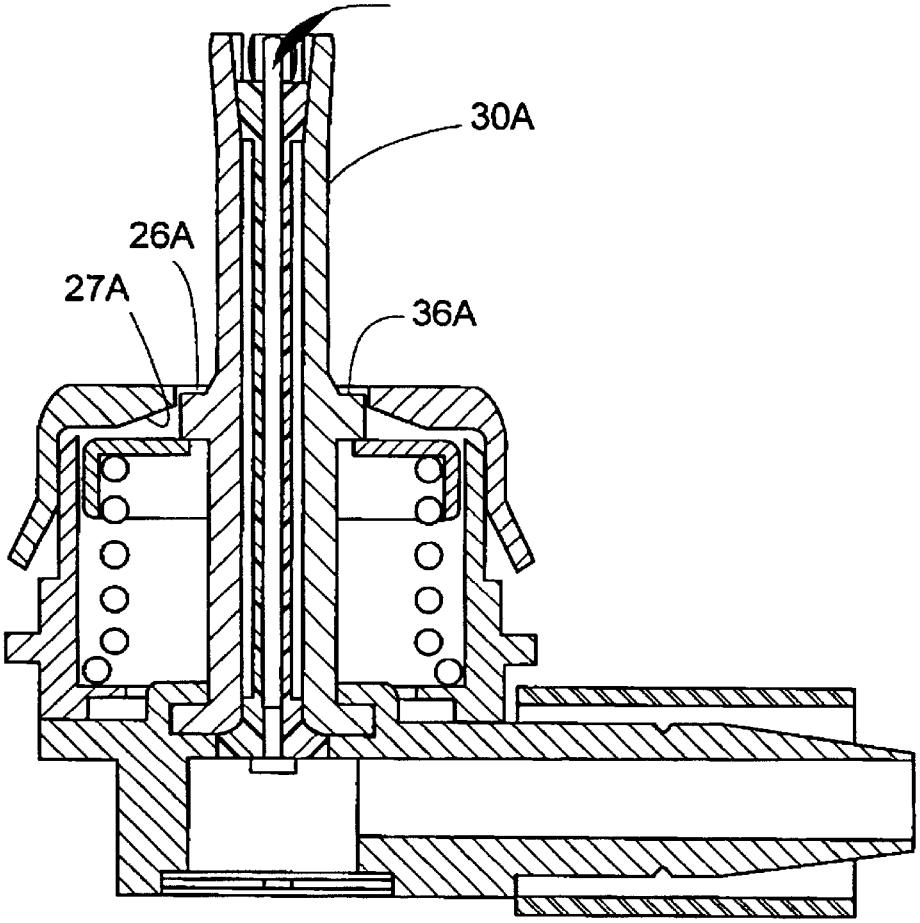
FIG. 14 is a vertical section of a further modified coaxial plug connector.

FIG. 14 shows a further modified coaxial plug connector which is identical to the above embodiment except that the inner periphery 27A of the top cover 24A is inclined with respect to the axis of the plug 30A for sliding contact with the outer edge of the ring-shaped collar 36A. Like parts are designated by like reference numerals with a suffix letter of "A". In this modification, the collar 36A is guided into the opening 26A by sliding engagement with the inclined inner periphery 27A when the plug 30A returns to the non-depressed position for centering the plug 30A.

What is claimed is:

1. A receptacle adapted for mating connection with a coaxial plug connector, said receptacle comprising:

a dielectric mold having a cavity;

an outer conductor shield being fitted on top of the mold and formed with an electrode socket for connection with an outer conductor tube of the coaxial plug connector, said electrode socket having a axis and a bottom at one axial end, the bottom being formed with a center opening communicating with the cavity of the mold, said outer conductor shield having a ground terminal lug projecting outwardly of the mold for electrical connection with an external circuit;

a single spring member mounted to the mold and having a center electrode resiliently movable along the axis of the socket, said center electrode extending from the cavity through the center opening of the electrode socket for pressed contact with a center conductor post of the coaxial plug connector, said spring member carrying a movable contact which is disposed within the cavity and is movable together with the center electrode, said spring member having a first signal terminal lug projecting outwardly of the mold for electrical connection with the external circuit; and a single fixed contact member mounted to the mold and having a fixed contact which is normally engaged with the movable contact by the bias of the spring member and is disengaged from the movable contact when the center electrode is depressed by the center conductor post of the coaxial plug connector, said fixed contact member having a second terminal lug projecting outwardly of the mold for electrical connection with the external circuit.

2. The receptacle as set forth in claim 1, wherein the outer conductor shield is supported onto the periphery of the mold to project the bottom of the socket into the cavity of the mold.

3. The receptacle as set forth in claim 1, wherein said spring member is formed by a single metal sheet to have the center electrode integrally struck therefrom and the movable contact bulged therefrom.

4. The receptacle as set forth in claim 1, wherein said spring member is formed with a first stab at an intermediate portion between the first terminal lug and the center electrode, said first stab being inserted into the mold for mounting the spring member to the mold, said movable contact being located at a portion adjacent the center electrode and opposite of the first stab from the center electrode.

5. The receptacle as set forth in claim 1, wherein said center electrode has a resiliently deformable contact tip for pressed contact with the center conductor post of the coaxial plug connector.

6. The receptacle as set forth in claim 1, wherein said movable contact is disposed within the cavity behind the bottom of the electrode socket to be spaced from the center opening in a lateral direction perpendicular to the axis of the socket.

7. The receptacle as set forth in claim 4, wherein said spring member has a bridge extending integrally between the first stab and the center electrode, said bridge being bent with respect to the length of the spring member for giving an enhanced resiliency by which the center electrode is allowed to move along the axis of the socket.

8. The receptacle as set forth in claim 1, wherein said center electrode is of an L-shaped configuration to have a vertical leg extending along the axis of the socket and a contact tip extending horizontally from one end of the leg in a direction perpendicular to the axis of the socket for direct contact with the center conductor post of the coaxial plug connector.

9. The receptacle as set forth in claim 8, wherein said contact tip has a return bent tab extending back into the center opening.

10. A combination of the receptacle recited in claim 1 and a coaxial plug connector for coupling a coaxial cable with the receptacle and comprising:

a mount base adapted to be fixed to a mounting structure; and a coaxial plug having a longitudinal axis and supported to the mount base to project therefrom, said coaxial plug having an insertion end at one axial end thereof for mating connection with the receptacle and having an anchor end at the opposite longitudinal end for connection with the coaxial cable, the outer conductor tube of the plug surrounding the center conductor post in an electrically insulating relation therefrom by means of a dielectric member fitted within the outer conductor tube, said dielectric member occupying a fraction of a space between the center conductor post and the outer conductor tube, thereby leaving an air layer extending along the length of the coaxial plug within the space.

11. The combination as set forth in claim 10, wherein said dielectric member is shaped into a dielectric barrel surrounding the center conductor post, said barrel having rings which are spaced axially along the plug and are held in close contact with the outer conductor tube to retain the barrel within the tube, said barrel being spaced radially at a portion other than the rings from the outer conductor tube so as to leave the air layer extending along the plug between the axially spaced rings.

12. The combination as set forth in claim 11, wherein said dielectric barrel is spaced from the center conductor post to leave therebetween an additional air layer extending axially along the plug.

13. The combination as set forth in claim 10, wherein said coaxial plug connector includes:

a spring which supports the coaxial plug floatingly to the mount base for urging the insertion end into pressed contact with the receptacle, an aligning mechanism which allows the coaxial plug to move in an axial direction thereof as well as in a lateral direction perpendicular to the axial direction for aligning the insertion end to the receptacle when mating the coaxial plug to the receptacle; and a self-centering means which causes said coaxial plug to return to a center position with respect to the lateral direction after the coaxial plug is disengaged from the receptacle.

14. The combination as set forth in claim 13, wherein said mount base has a top cover with an opening through which the coaxial plug extends, said self-centering means comprises a collar fixedly surrounding the coaxial plug at a portion intermediate between the insertion end and the anchor end, the top cover, and the spring, said top cover having an inner peripheral surface defining said opening, said collar having a root section which fits into said opening when the coaxial plug is in a non-depressed position as disengaged from the receptacle, said collar having a slide surface which comes into slide contact with the inner peripheral surface around the opening when said coaxial plug moves axially by the bias of the spring from a depressed position to the non-depressed position, at least one of the slide surface of the collar and the inner peripheral surface of the top cover being inclined with respect to the axial direction of the coaxial plug so as to translate the axial movement of the collar due to the bias of the spring into a lateral movement of the collar for guiding the root section of the collar into the opening, thereby centering the coaxial plug.

15. The combination as set forth in claim 14, wherein said collar is formed as an integral part of the outer conductor tube and is shaped into a conical configuration of which conical face defines the slide surface.

* * * * *

UNITED STATES PATENT AND TRADEMARK OFFICE

CERTIFICATE OF CORRECTION

PATENT NO. : 6,296,492 B1
DATED : October 2, 2001
INVENTOR(S) : Fujimoto et al.

It is certified that error appears in the above-identified patent and that said Letters Patent is hereby corrected as shown below:

Title page,
Item [30], the Foreign Application Priority information should read:

-- (30) Foreign Application Priority Data

Mar. 31, 2000 (JP) ..... 12-099337
Mar. 31, 2000 (JP) ..... 12-099338
May. 26, 2000 (JP) ..... 12-157273 --

Signed and Sealed this

Eleventh Day of June, 2002

*Attest:*

*Attesting Officer*

JAMES E. ROGAN
*Director of the United States Patent and Trademark Office*